US008157597B2

(12) United States Patent
Chang

(10) Patent No.: US 8,157,597 B2
(45) Date of Patent: Apr. 17, 2012

(54) CONTACT PIN STRUCTURE

(75) Inventor: I-Chang Chang, Sijhih (TW)

(73) Assignee: Iwei Technology Co., Ltd., Taipei County (TW)

( * ) Notice: Subject to any disclaimer, the term of this patent is extended or adjusted under 35 U.S.C. 154(b) by 0 days.

(21) Appl. No.: 12/000,085

(22) Filed: Dec. 7, 2007

(65) Prior Publication Data

US 2011/0159712 A1 Jun. 30, 2011

(51) Int. Cl.
*H01R 24/00* (2006.01)

(52) U.S. Cl. ..... 439/660

(58) Field of Classification Search ..... 439/660, 439/862, 700

See application file for complete search history.

(56) References Cited

U.S. PATENT DOCUMENTS

| | | | | |
|---|---|---|---|---|
| 3,964,816 | A * | 6/1976 | Narozny | 439/397 |
| 4,171,858 | A * | 10/1979 | Knowles et al. | 439/397 |
| 4,778,404 | A * | 10/1988 | Pass | 439/387 |
| 4,857,001 | A * | 8/1989 | Nakano et al. | 439/68 |
| 5,738,532 | A * | 4/1998 | Takano et al. | 439/79 |
| 6,083,059 | A * | 7/2000 | Kuan | 439/862 |
| 6,142,820 | A * | 11/2000 | Sook | 439/397 |
| 6,358,097 | B1 * | 3/2002 | Peters | 439/700 |
| 6,402,567 | B1 * | 6/2002 | Zhu | 439/700 |
| 6,461,175 | B2 * | 10/2002 | Okamoto | 439/92 |
| 6,572,386 | B1 * | 6/2003 | Howell et al. | 439/66 |
| 6,875,923 | B2 * | 4/2005 | Egawa et al. | 174/68.2 |
| 6,939,142 | B2 * | 9/2005 | Maruyama et al. | 439/66 |
| 6,945,827 | B2 * | 9/2005 | Grube et al. | 439/700 |
| 7,270,550 | B1 * | 9/2007 | Peng | 439/66 |
| D568,248 | S * | 5/2008 | Chen et al. | D13/133 |
| 7,527,532 | B2 * | 5/2009 | Northey | 439/700 |
| 7,601,034 | B1 * | 10/2009 | Aekins et al. | 439/676 |
| 7,607,952 | B2 * | 10/2009 | Tai | 439/700 |
| 7,731,546 | B2 * | 6/2010 | Grube et al. | 439/700 |
| 2003/0032313 | A1 * | 2/2003 | Kojima et al. | 439/79 |
| 2004/0137767 | A1 * | 7/2004 | Suzuki et al. | 439/73 |
| 2005/0000720 | A1 * | 1/2005 | Egawa et al. | 174/68.2 |
| 2010/0055992 | A1 * | 3/2010 | Liu et al. | 439/733.1 |

* cited by examiner

*Primary Examiner* — Tulsidas C Patel
*Assistant Examiner* — Vladimir Imas
(74) *Attorney, Agent, or Firm* — Leong C. Lei

(57) ABSTRACT

A structural improvement for a contact pin, in which a contact pin is provided with a main body, from one end of which extends a connecting portion, and a contact portion extends from the other end. The contact portion is provided with tapered sections which form a terminal. Accordingly, when using the contact pin, combination of the tapered sections and the terminal of the contact portion enables accommodating electrical portions of different types of batteries and forming a corresponding electrical contact therewith, thereby achieving practical advancement enabling universal use of the single contact pin to accommodate many kinds of specifications.

8 Claims, 14 Drawing Sheets

CONTACT PIN STRUCTURE

BACKGROUND OF THE INVENTION (a) Field of the Invention

The present invention provides a contact pin, and more particular provides a structural improvement for a contact pin to enable accommodating electrical portions of different types of batteries and form electrical contact with the contact pin.

(b) Description of the Prior Art

Regardless of the portable electronic product, including digital cameras, mobile phones, notebook computers, hand-held amusement games, and the like, batteries are contained inside all such portable electronic products, and the required electric power is supplied via the batteries when the portable electronic product is running.

Technological progress and respect for environmental consciousness has brought about the development in battery technology. The early carbon-zinc dry cell batteries have given way to nickel cadmium batteries, nickel hydrogen batteries, lithium sulfur batteries or lithium batteries as the electric power source. Apart from being of small size and light, the new types of batteries are provided with the characteristic of being rechargeable during use. Hence, many portable electronic products have placed within them either nickel cadmium batteries, nickel hydrogen batteries, lithium sulfur batteries or lithium batteries complying with their respective specifications, and are used as the electric power source thereof.

When the electric power of the nickel cadmium batteries, nickel hydrogen batteries, lithium sulfur batteries or lithium batteries is exhausted, the batteries can be taken out of the electronic product and recharged using an external recharging device, generally known as a battery charger. A recess of the battery charger is configured as a holding recess, within which is configured contact pins, thereby enabling electrical contact with electrical portions of a battery by means of the contact pins, after which the battery charger transmits external electric power to within the battery, and thus enable the battery to be fully recharged with electric power.

Referring to FIG. 1, which shows a combination schematic view 1 of a battery charger and a battery, and from the drawing it can be clearly seen that a battery charger A is configured with a holding recess A0, an inner wall of which is configured with a plurality of contact pins C. After a battery B is disposed within the holding recess A0, then each electrical portion D of the battery B forms an electrical contact with the respective contact pin C, thereby enabling the battery charger A to transmit external electric power, such as the mains power supply, to within the battery B. Furthermore, it can be seen from the drawing that the electrical portions D of the battery B are configured to be tabular, therefore shape of the contact pins C of the battery charger A are configured as protruding arcs or 90 degree turned V-shaped forms in order to match the tabular electrical portions D.

Referring to FIG. 2, which shows a combination schematic view 2 of a battery charger and a battery, and from the drawing it can be clearly seen that electrical portions D1 of a battery B1 are configured as tubular hollow cavities, therefore shape of contact pins C1 of a battery charger A1 are configured as columnar forms in order to match the tubular cavity shaped electrical portions D1. When the battery B1 is disposed within a holding recess A10 for charging thereof, then the contact pins C1 are made to respectively penetrate within the electrical portions D1 to form electrical contacts therewith.

Referring to FIG. 3, which shows a combination schematic view 3 of a battery charger and a battery, and from the drawing it can be clearly seen that electrical portions D2 of a battery B2 are configured as juxtaposed cavities, therefore shape of contact pins C2 of a battery charger A2 are configured as juxtaposed tabular strips in order to match the juxtaposed cavity shaped electrical portions D2. When the battery B2 is disposed within a holding recess A20 for charging thereof, then the contact pins C2 are made to respectively penetrate within the electrical portions D2 to form electrical contacts therewith.

Accordingly, from the above it can be known that different types of the battery B are used in different types of electronic devices, which results in the need for different types of the electrical portions D. Hence, manufacturers of the battery charger A must design different types of the contact pins C to enable the battery charger A to accommodate and charge the different batteries B. Hence, it is the strong desire of the inventor and manufacturers engaged in related art and purpose of the present invention to resolve and surmount existent technical difficulties to solve the aforementioned problems and shortcomings of the inability for universal use of the battery charger A resulting from the numerous specifications of the prior art contact pins.

SUMMARY OF THE INVENTION

A primary objective of the present invention is to provide a contact pin, one end of a main body of which extends a bent contact portion; the contact portion is tabular, two sides of which are respectively provided with a tapered section, and the junction of the tapered sections forms a terminal. Use of the aforementioned technology provides a breakthrough in overcoming existing problems of the inability for universal use of a battery charger resulting from the numerous specifications of the prior art contact pins, and achieves practical advancement in enabling the contact pins to accommodate electrical portions of different types of batteries and form electrical contacts therewith.

A second objective of the present invention is to provide one end of the main body of the contact pin with a connecting portion, and provide the other end with the contact portion, wherein the contact portion either assumes horizontality, perpendicularity or forms an angular difference height position with the connecting portion. Use of the aforementioned technology enables the contact portion to produce an elastic restoring displacement, which is able to produce tight elastic support, and achieves practical advancement not conceived of in the prior art contact pins.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 4:
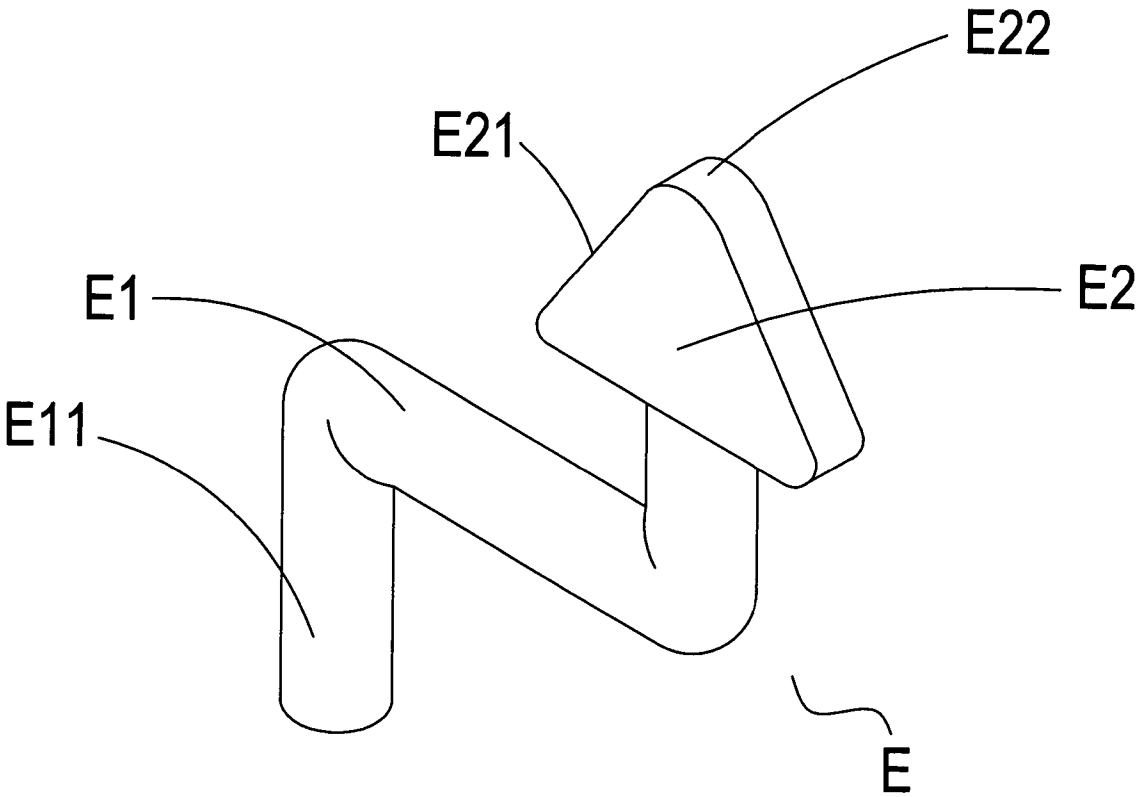
FIG. 4 shows an external elevational view of the present invention.
Figure 5:
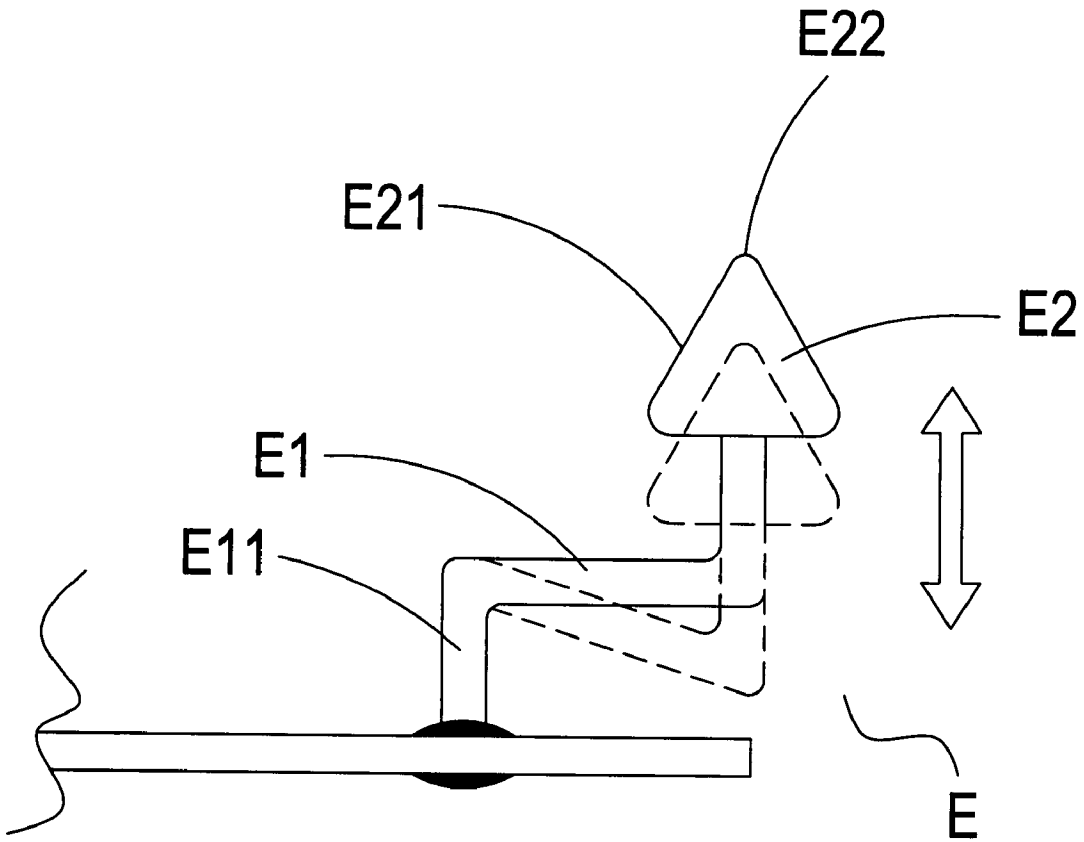
FIG. 5 shows a schematic view depicting movement of the present invention.

Referring to FIGS. 4, 5, which show a contact pin E provided with a main body E1, from one end of which extends a bent connecting portion E11. The connecting portion E11 is able to electrically connect to a predetermined circuit board by means of welding, heat sealing or plugging in methods.

A bent contact portion E2 extends from another end of the main body E1, and the contact portion E2 is tabular and provided with tapered sections E21, from which extends a terminal E22.

After the connecting portion E11 of the contact pin E is connected to the predetermined circuit board, because a horizontal height difference forms between the connecting portion E11 and the contact portion E2, thus, when pressure is applied on the contact portion E2 from an external force, such as the electrical portion of a battery, then a displacement is produced about the connecting portion E11 and the bent portion of the main body E1 serving as an axle center and the main body E1 serving as a shaft lever, thereby causing elastic displacement of the main body E1. Moreover, because the main body E1 is made from metal material, and thus provided with elasticity, under the aforementioned situation, elasticity of compression is produced when the main body E1 and the bent portion of the connecting portion E11 are subjected to an external force.

When the external force exerted on the contact portion E2 is released, then the original elasticity of compression of the bent portion of the main body E1 is also released from the connecting portion E11, thereby causing displacement of the main body E1 which restores the contact portion E2 to its original position. The aforementioned means enables producing elastic displacement of the contact portion E2 of the contact pin E, and when in use, such elastic displacement is used to support a device connected thereto, such as the electrical portion of a battery.

Figure 6:
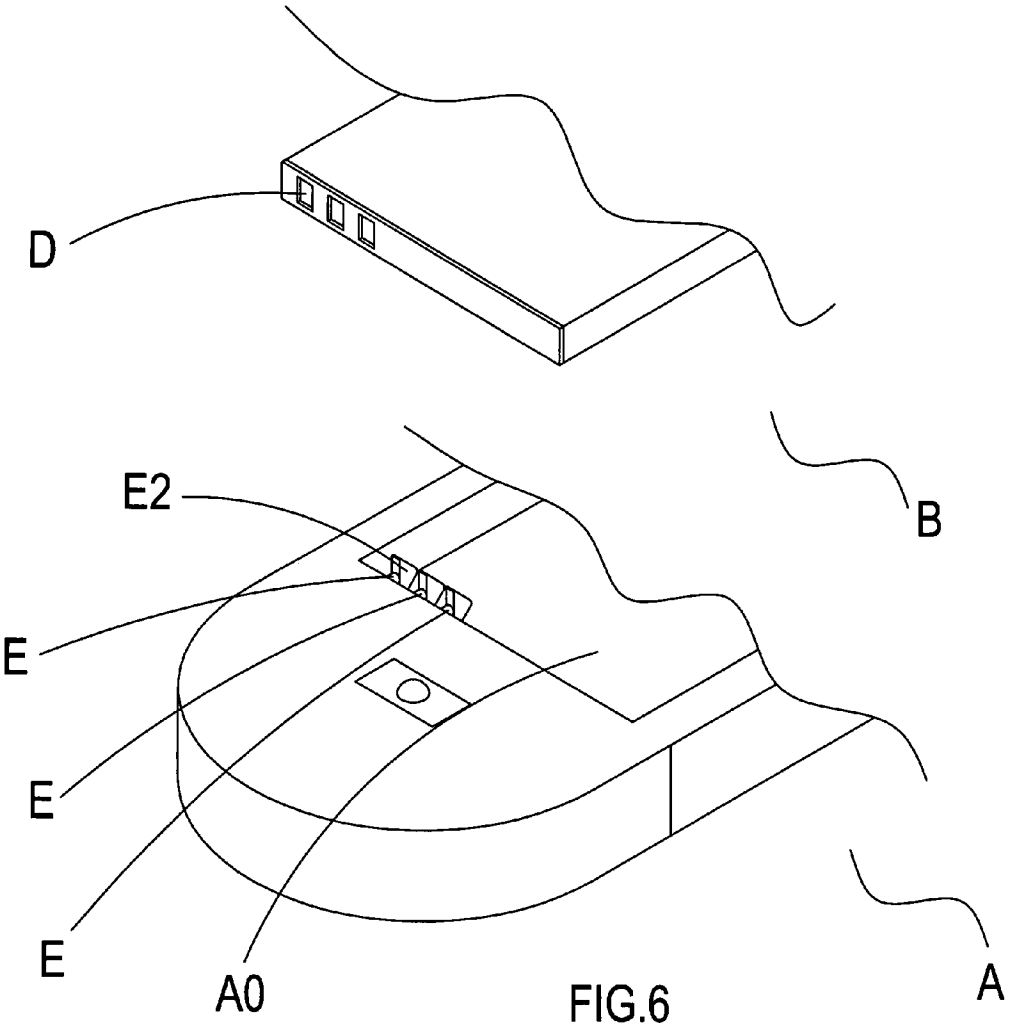
FIG. 6 shows a schematic view depicting a use mode of the present invention.
Figure 7:
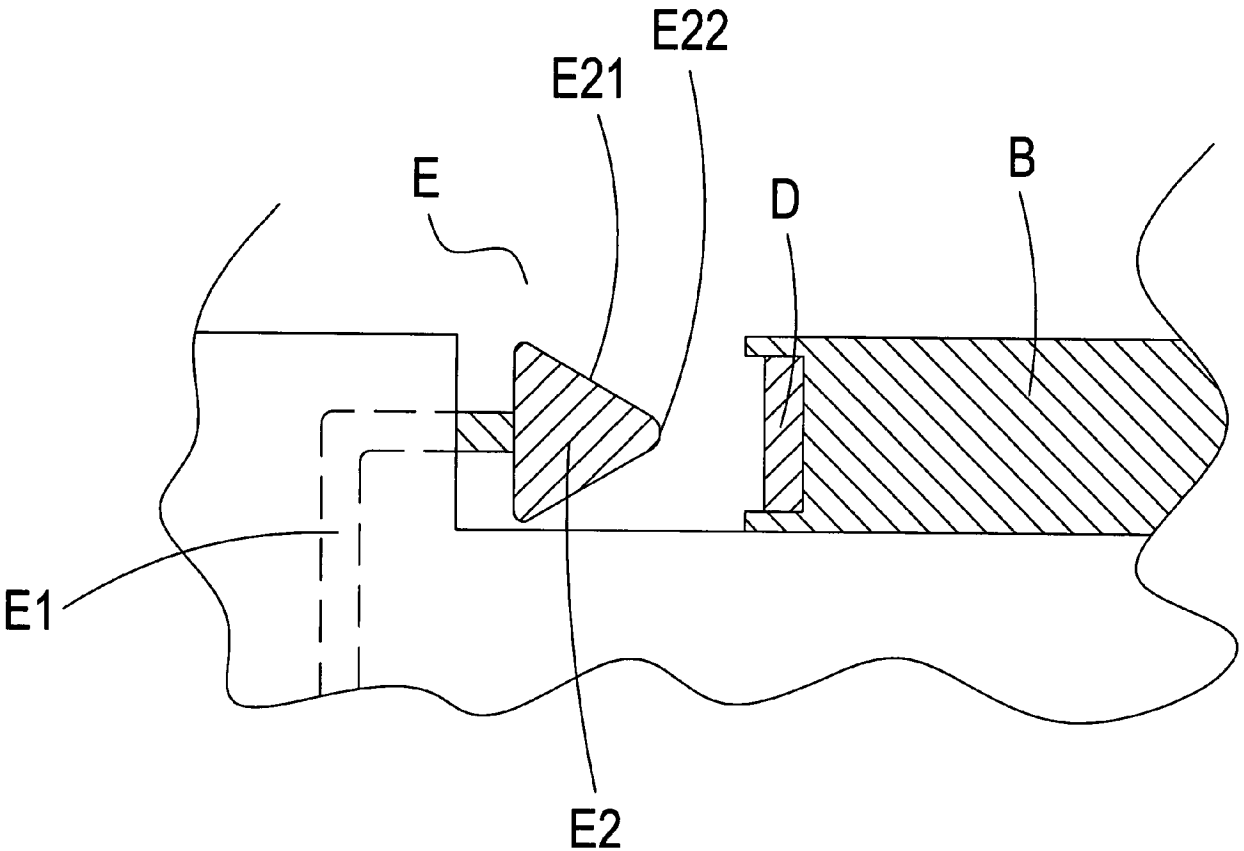
FIG. 7 shows a cutaway view 1 depicting a use mode of the present invention.

Referring to FIGS. 6, 7, wherein a battery charger A is configured with a plurality of the contact pins E. The contact portion E2 of each of the contact pins E penetrate an inner wall of a holding recess A0, thus, when a battery B is placed within the holding recess A0 of the battery charger A, then electrical portions D of the battery B respectively form an electrical contact with the contact pins E, thereby enabling the battery charger A to transmit external electric power, such as the mains power supply, to within the battery B. Moreover, it can be seen form the drawings that the electrical portions D of the battery B are configured to be tabular, and that each of the contact pins E are provided with the terminal E22. Accordingly, when the contact portions E2 of the contact pins E make contact with the electrical portions D, then the terminals E22 form electrical contact with the electrical portions D, thereby enabling electric power from the battery charger A to be transmitted to the electrical portions D through the terminals E22 of the contact pins E, and then transmitted to the within the battery B through the electrical portions D. The majority of batteries as exemplified by the battery B are used in electronic devices such as digital cameras, mobile phone, and the like.

Figure 1:
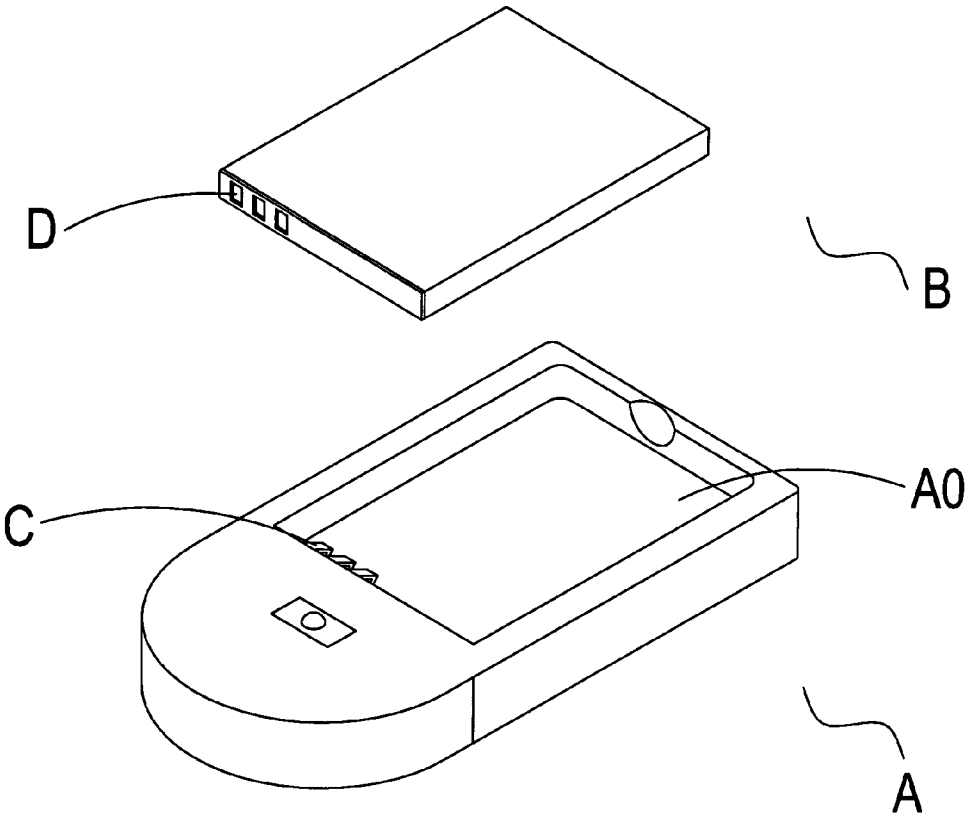
FIG.1 Prior Art
FIG. 1 shows a combination schematic view 1 of a battery charger of the prior art and a battery.
Figure 2:
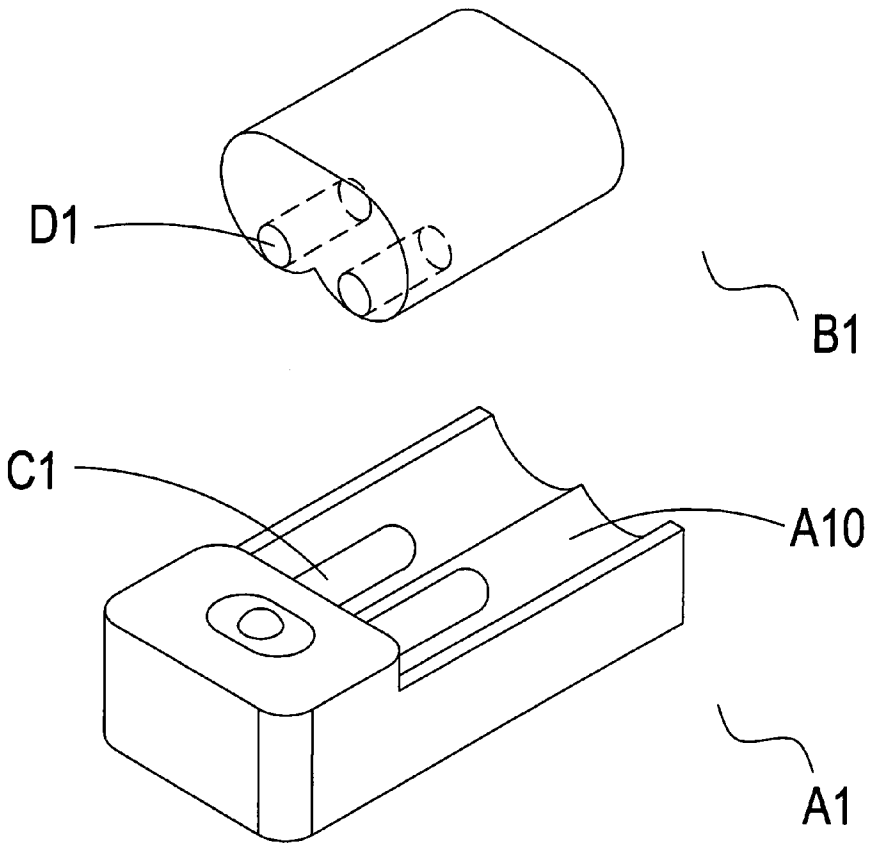
FIG.2 Prior Art
FIG. 2 shows a combination schematic view 2 of a battery charger of the prior art and a battery.
Figure 8:
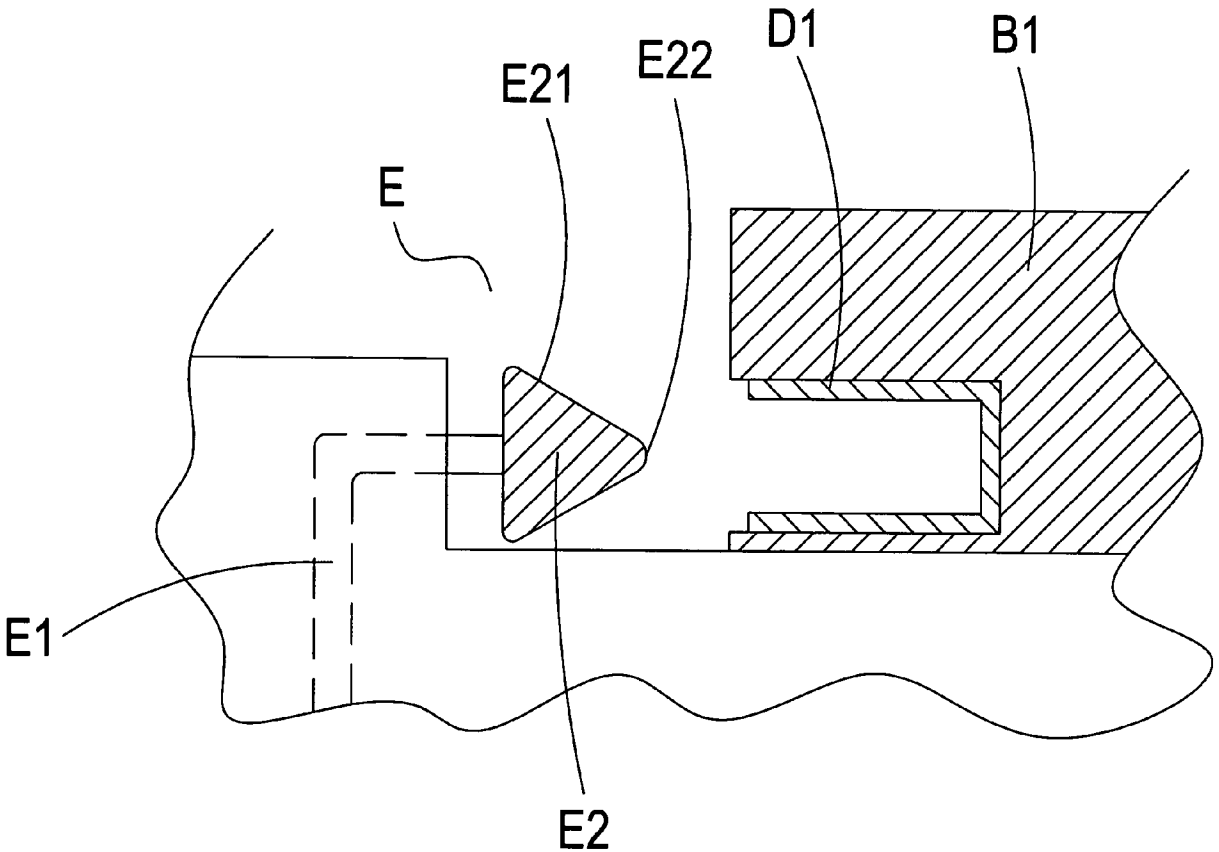
FIG. 8 shows a cutaway view 2 depicting a use mode of the present invention.

Referring to FIGS. 2 and 8, in which it can be clearly seen from FIG. 2 that electrical portions D1 of a battery B1 are tubular hollow cavities, and it can be seen from FIG. 8 that when joining together the contact pins E of the present invention with the battery B1 of FIG. 2, when each of the contact portions E2 of the contact pins E provided with the tapered sections E21 and the terminal E22 make contact with the respective electrical portion D1, then the terminals E22 first respectively pass into the interiors of the electrical portions D1 until the tapered sections E21 respectively make contact with the tubular walls of the electrical portions D1, after which the contact portions E2 respectively form electrical contacts with the electrical portions D1. The majority of batteries as exemplified by the battery B1 are used in electronic devices such as cameras, and the like.

Figure 3:
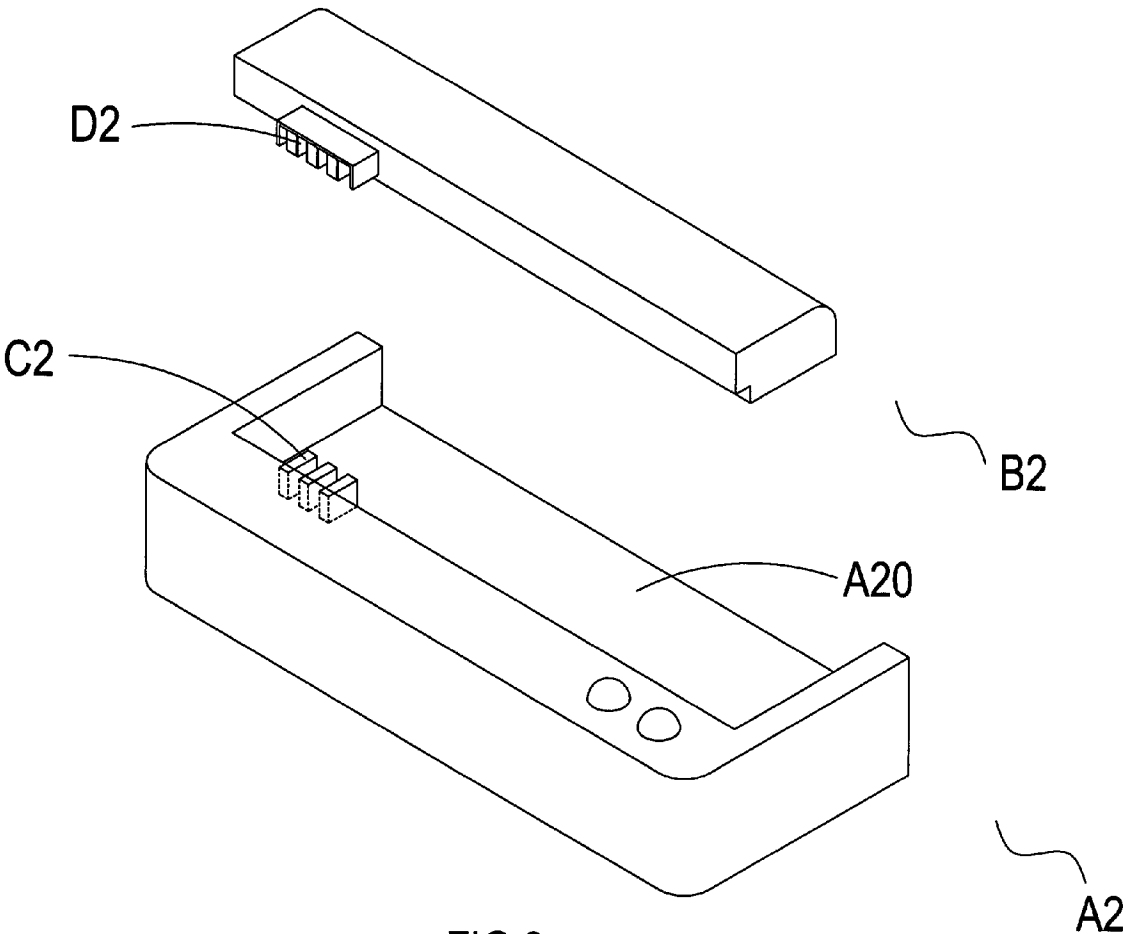
FIG.3 Prior Art
FIG. 3 shows a combination schematic view 3 of a battery charger of the prior art and a battery.
Figure 9:
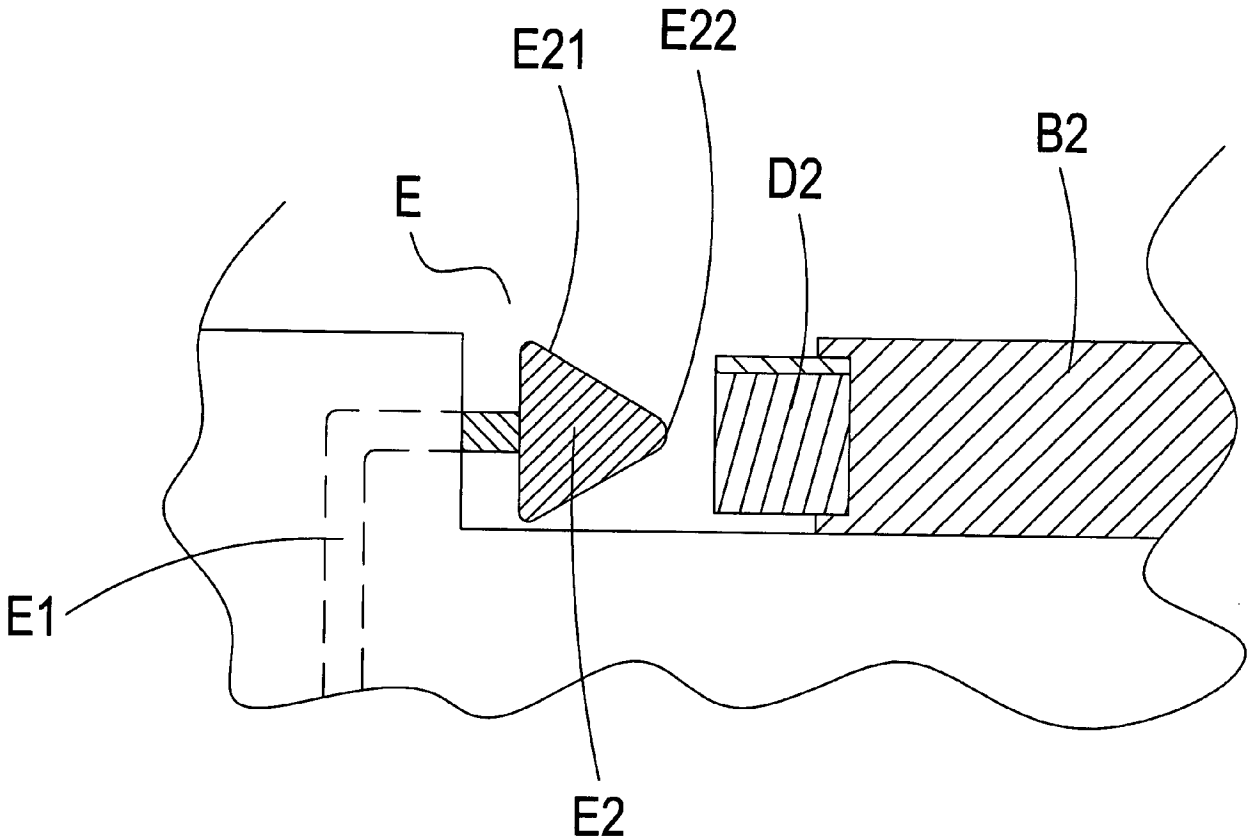
FIG. 9 shows a cutaway view 3 depicting a use mode of the present invention.

Referring to FIGS. 3 and 9, in which it can be clearly seen from FIG. 3 that electrical portions D2 of a battery B2 are juxtaposed cavities, and it can be seen from FIG. 9 that when joining together the contact pins E of the present invention with the electrical portions D2 of the battery B2, when the contact portions E2 of the contact pins E respectively make contact with the electrical portions D2, then the tabular form of each of the contact portions E2 enables complete retention within the respective electrical portions D2, thereby effecting electrical connections with the electrical portions D2. The majority of batteries as exemplified by the battery B2 are used in electronic devices such as notebook computers, and the like.

Figure 10:
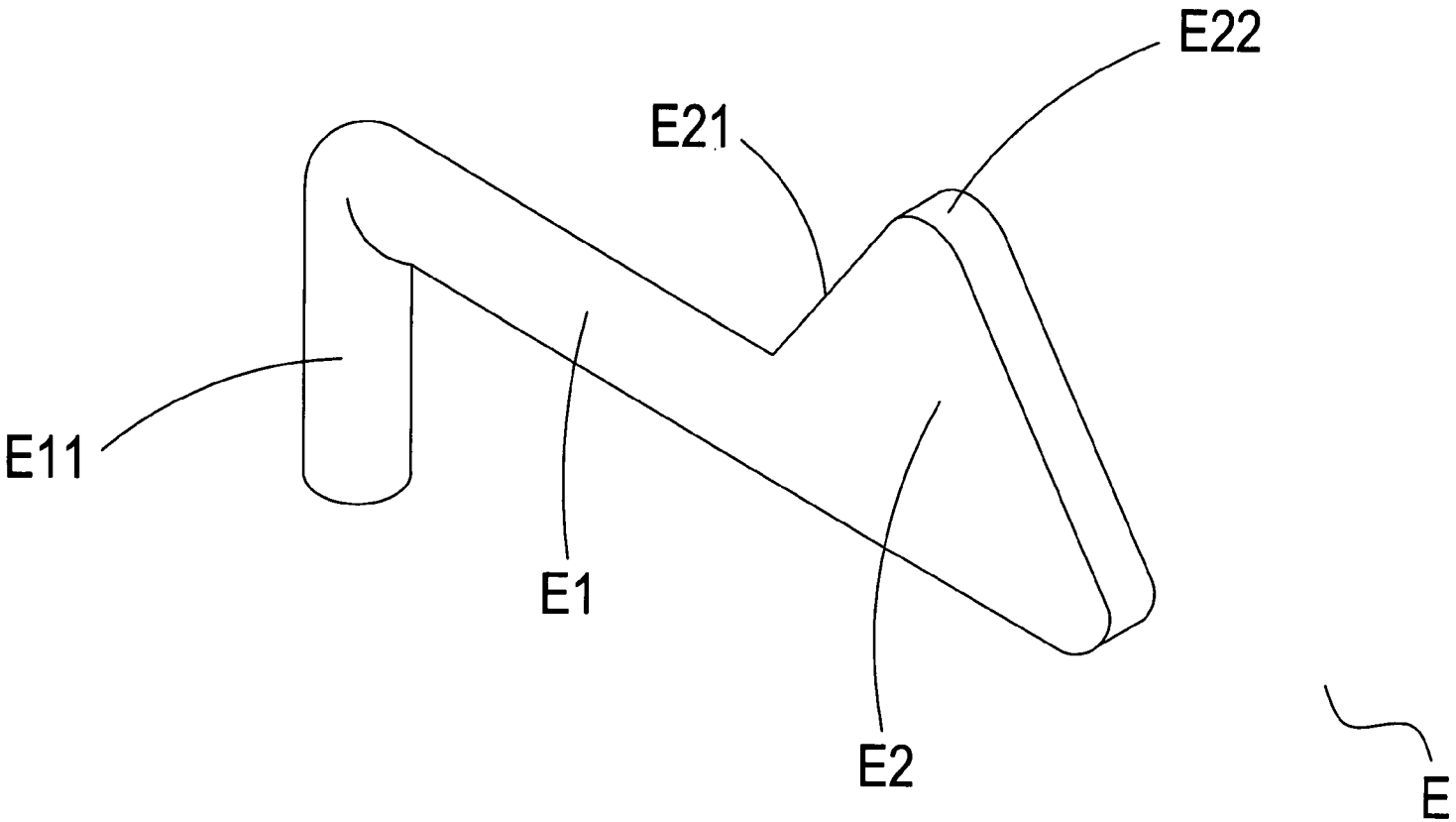
FIG. 10 shows an external elevational view 1 of a further embodiment according to the present invention.
Figure 11:
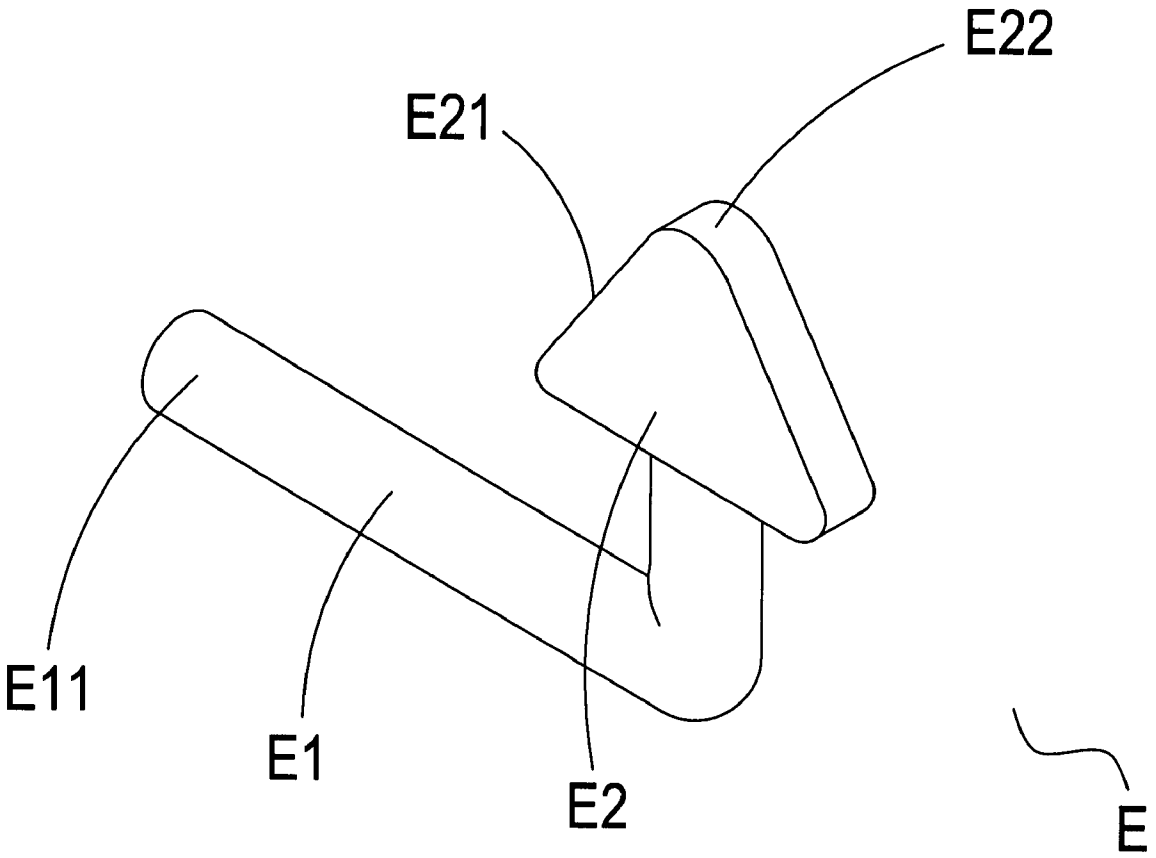
FIG. 11 shows an external elevational view 2 of a further embodiment according to the present invention.

Referring to FIGS. 10, 11, the connecting portion E11 or the contact portion E2 are configured either to extend parallel to, perpendicular to or extend to form an angular difference with the main body E1 of the contact pin E. Moreover, either a horizontal form, a vertical form or an angular difference can be assumed between the connecting portion E11 and the contact portion E2. Accordingly, a height difference is formed between the connecting portion E11 and the contact portion E2, and after the contact portion E2 is subjected to an external pressure, then a displacement is produced about the connecting portion E11 serving as an axle center and the main body E1 serving as a shaft lever, thereby causing elastic displacement of the main body E1. When the external force exerted on the contact portion E2 is released, then the original elasticity of compression between the connecting portion E11 and the main body E1 is also released, thereby causing elastic restoring displacement of the main body E1 which restores the contact portion E2 to its original position. The aforementioned means enables producing elastic displacement of the contact portion E2 of the contact pin E, and when in use, such elastic displacement is used to support a device connected thereto, such as the use modes as depicted in FIGS. 6-9.

Figure 12:
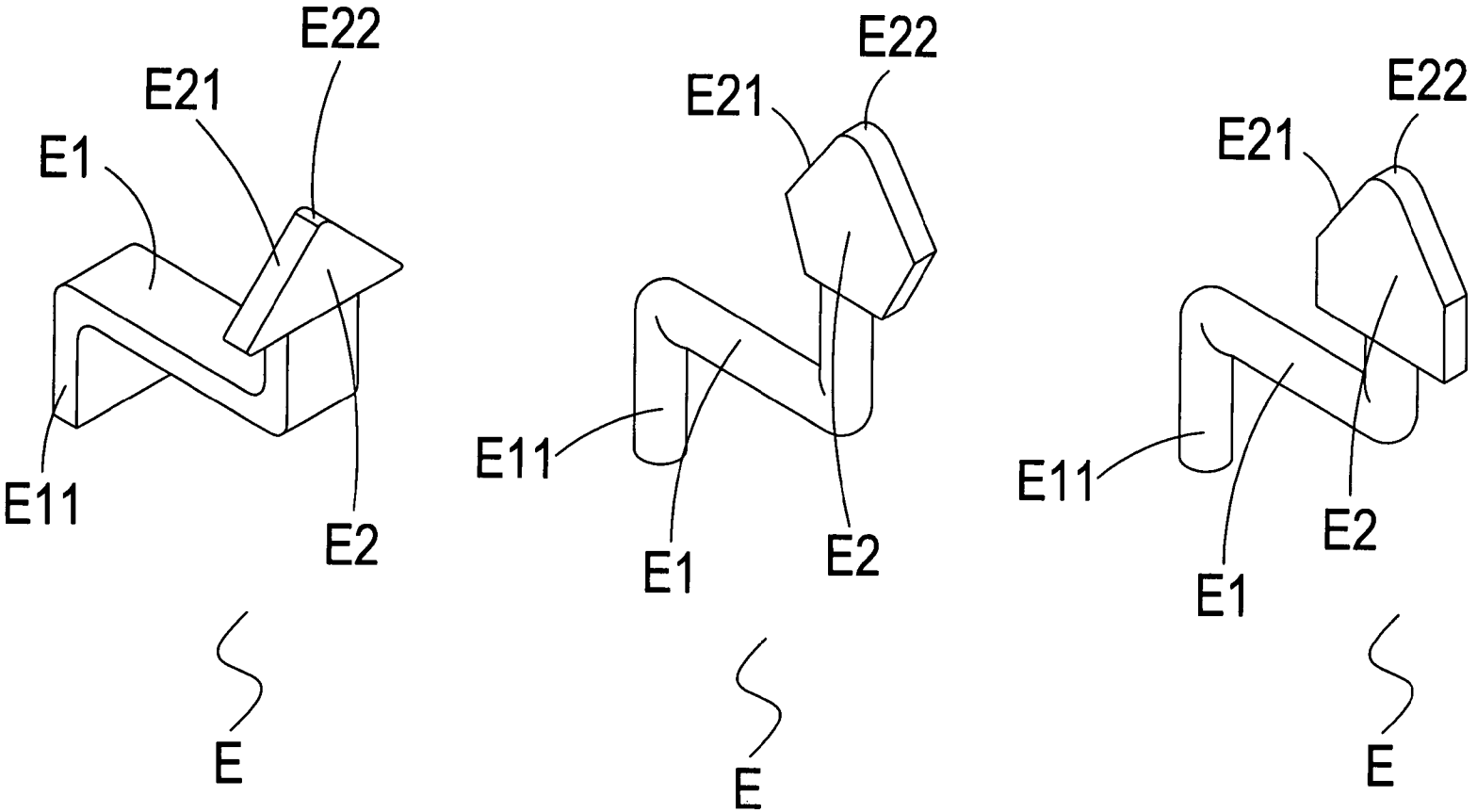
FIG. 12 shows external elevational views 3 of further embodiments according to the present invention.

Referring to FIG. 12, which shows that the main body E1 of the contact pin E can be configured either to be columnar, tubular, lamellar or tabular shaped, and the contact portion E2 can be configured to be either of tapered form, triangular shaped, diamond shaped, kite shaped or provided with at least three exterior edges to accommodate devices of different types, such as the use modes as depicted in FIGS. 6-9.

Figure 13:
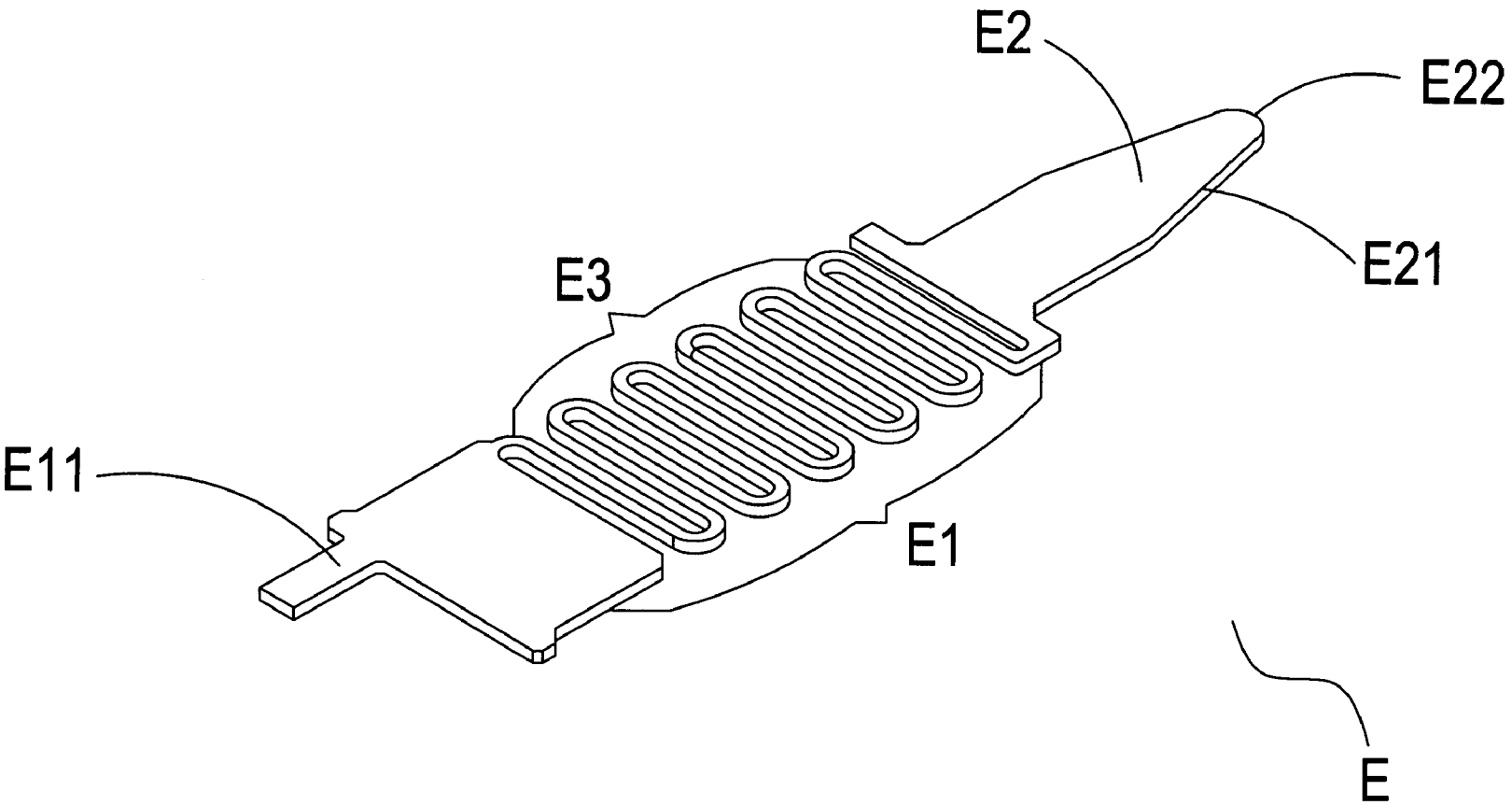
FIG. 13 shows an external elevational view of a further embodiment according to the present invention.
Figure 14:
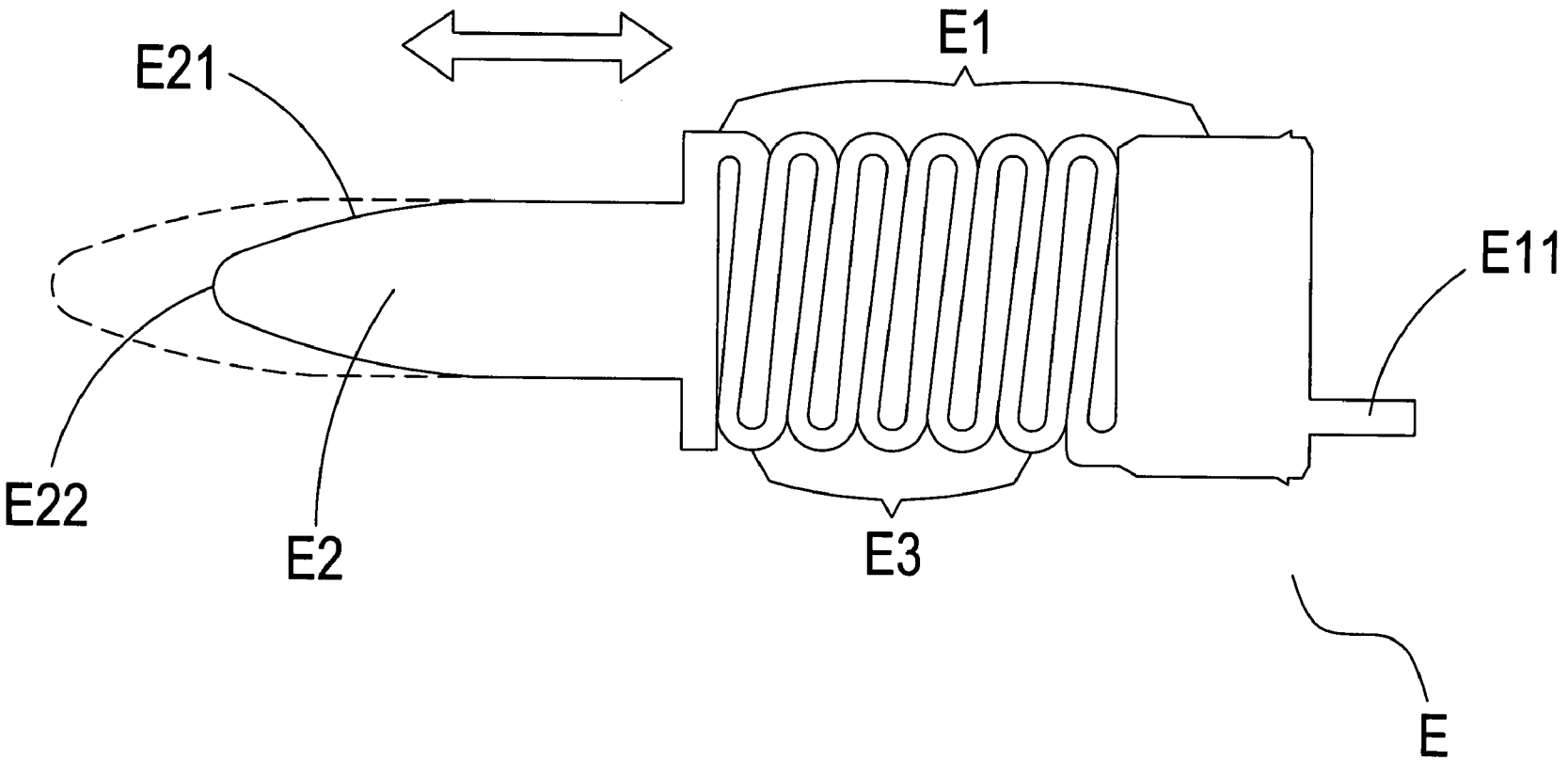
FIG. 14 shows a schematic view depicting movement of the further embodiment according to the present invention.

Referring to FIGS. 13, 14, which show the contact pin E provided with the main body E1, one end of which extends the connecting portion E11, and the contact portion E2 extends from the other end, wherein the contact portion E2 is tabular shaped and is provided with tapered sections E21. A terminal E22 extends from the tapered sections E21.

In addition, an elastic section E3 is located at an appropriate position of the main body E1, thus, when the contact portion E2 is subjected to external pressure, then the elastic section E3 is caused to deform, thereby producing elasticity of compression. After the external force on the contact portion E2 is released, then the elasticity of compression of the elastic section E3 is also released, thereby causing the contact portion E2 to return to its original position. Accordingly, the contact pin E is able to achieve the functional effectiveness as depicted in FIGS. 6-9.

Hence, referring to all the drawings, advantages of the present invention are described as follows:

(1) The contact pin E is provided with the tabular shaped contact portion E2, and the contact portion E2 is provided with the two tapered sections E21. Moreover, the terminal E22 extends from the junction of the tapered sections E21, thereby achieving the practical advancement of enabling the contact pins E to accommodate the electrical portions D of different types of the battery B and effect an electrical contact therewith.

(2) Bending the main body of E1 of the contact pin E establishes a height difference between the connecting portion E11 and the contact portion E2, and the main body E1 is used to produce elastic bending or elastic deformation, thereby enabling the contact portions E2 to elastically support the electrical portions D of different types of the battery B and produce good electrical contact therewith. Moreover, after removing the battery B, the main body E1 of each of the contact pins elastically restores their original state.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A battery contact pin structure of a battery compartment, comprising:

a main body made of metal material and provided with elasticity;

a connecting portion extending from an end of said main body and connected to a circuit board;

a contact portion extending from another end of said main body and capable of contacting an electrical portion of a battery, said contact portion being tabular and provided with tapered sections from which extends a terminal;

characterized in that:

said main body has a horizontal portion having an end which extends downwardly to form said connecting portion;

said horizontal portion of said main body has another end which extends upwardly to form said contact portion;

a horizontal height forms between said connecting portion and said contact portion so that when pressure is applied on said contact portion from said electrical portion of said battery, a displacement will be produced about said connecting portion and a bent portion of said main body will serve as an axle center and said main body will serve as a shaft lever, thereby causing elastic displacement of said main body.

2. The battery contact pin structure as claimed in claim 1, wherein said main body is configured either to be columnar, tubular, lamellar, or tabular shaped.

3. The battery contact pin structure as claimed in claim 1, wherein said bent contact portion is either of tapered form, triangular shaped, diamond shaped, kite shaped or polygon shaped.

4. The battery contact pin structure as claimed in claim 1, wherein said contact portion is either of lamellar or tabular shaped.

5. The battery contact pin structure as claimed in claim 1, wherein said contact portion is configured either to extend parallel to, perpendicular to or extend to form an angular difference with said main body.

6. The battery contact pin structure as claimed in claim 1, wherein said main body, said connecting portion and said contact portion lie on the same plane.

7. The battery contact pin structure as claimed in claim 1, wherein said main body is further configured with an elastic section.

8. The battery contact pin structure as claimed in claim 7, wherein said elastic section is either a continuous bent form, a wave form or a continuous winding form.

* * * * *